United States Patent [19]

Sunstein

[11] 4,295,204

[45] Oct. 13, 1981

[54] PROGRAMMABLE CORRELATOR

[76] Inventor: Drew E. Sunstein, 19 Parkhurst Dr., Nashua, N.H. 03060

[21] Appl. No.: 44,392

[22] Filed: May 31, 1979

[51] Int. Cl.[3] ..... G06G 7/19

[52] U.S. Cl. ..... 364/824; 364/604; 364/862

[58] Field of Search ..... 364/728, 824, 862

[56] References Cited

U.S. PATENT DOCUMENTS

| | | | |
|---|---|---|---|
| 3,935,439 | 1/1976 | Buss et al. | 364/824 |
| 4,100,513 | 7/1978 | Weckler | 364/862 X |
| 4,103,333 | 7/1978 | Poirier et al. | 364/862 X |
| 4,120,035 | 10/1978 | Cases et al. | 364/862 X |
| 4,156,876 | 5/1979 | Debuisser | 364/728 X |
| 4,156,924 | 5/1979 | Lampe et al. | 364/862 X |
| 4,161,033 | 7/1979 | Martinson | 364/728 |

OTHER PUBLICATIONS

Strasilla et al.; Analog-Analog Correlator/Convolver Proceedings of the 4th European Solid State Circuits Conference, Sep. 1978.

*Primary Examiner*—Felix D. Gruber
*Attorney, Agent, or Firm*—Bruce D. Sunstein

[57] ABSTRACT

A programmable correlator correlates a sampled information signal with a programmable reference signal. The correlator utilizes a plurality of stages. Each stage includes an information register, a multiplier, and a reference register. The correlator in some embodiments permits storage in the reference registers of a series of samples of a signal related to the reference signal during the time that the sampled information signal is cascaded from one information register to the next.

6 Claims, 5 Drawing Figures

PROGRAMMABLE CORRELATOR

DESCRIPTION

1. Technical Field

The present invention relates generally to electronic signal processing, and particularly to correlation of one signal with another. When one of the signals with respect to which correlation is made is a reference signal of suitable shape, the invention is applicable to generalized filters of signals.

2. Background Art

Signal correlation is known in the prior art. In situations where real-time processing is not desired, signals have been sampled and then correlated using well-known digital techniques. In many instances, however, it is important to accomplish correlation in real time. Where an information signal is being correlated with a reference signal of specified characteristics, the correlation signal output can be regarded as a filtered output of the information signal.

In producing such a filter, it has been known in the prior art to utilize the equivalent of a tapped delay line for each of the signals being correlated; between corresponding taps of each delay line is placed a multiplier, and the outputs of the multipliers are then summed. This particular configuration is suited to correlation of two time-varying signals. The tapped delay line equivalents in such devices are often accomplished by use of charge-transfer devices. Such devices are used to store and transfer a signal along the delay-line equivalent. In consequence, such devices are not suited to use of a reference signal that is slowly varying or stationery in relation to the information signal.

DISCLOSURE OF INVENTION

It is an object of the present invention to provide a novel programmable correlator.

It is also an object of the present invention to provide, for an information signal, a filter based on the shape of a reference signal.

It is a further object of the present invention to provide a programmable correlator that can be constructed in whole or in part utilizing integrated circuit technology.

It is further object of the present invention to provide a programmable correlator for use in filtering either in recursive or nonrecursive contexts, and in all general filter applications.

These and other objects of the invention are achieved by providing, for correlation of a sampled information signal with a programmable reference signal, a plurality of correlator stages connected in cascade, each stage including an information register having an input for receiving a sample of the information signal; a reference register having an input for receiving a signal related to the programmable reference signal; a multiplier, having inputs connected to outputs of the information register and the reference register and an output related to the product of the signals present at its inputs; and a means for transferring the sample of the information signal from an output of the information register to the input of the information register in the next successive stage, wherein such transfer is accomplished without any undesirable amount of change in the signal stored in the reference register. The programmable reference signal may or may not, depending upon the appropriate design in accordance with the present invention, exist as a measurable signal. It may exist only heuristically as a function of the contents of the various reference registers in a device constructed in accordance with the invention. The information signal may be any type of signal whatever, including, for example, an audio signal, a television signal, or any other signal for which filtering may be deemed appropriate.

BRIEF DESCRIPTION OF THE DRAWINGS

These and other objects and features of the invention will be more readily understood by consideration of the following detailed decription taken with the accompanying drawings, in which.

DESCRIPTION OF SPECIFIC EMBODIMENTS

Figure 1:
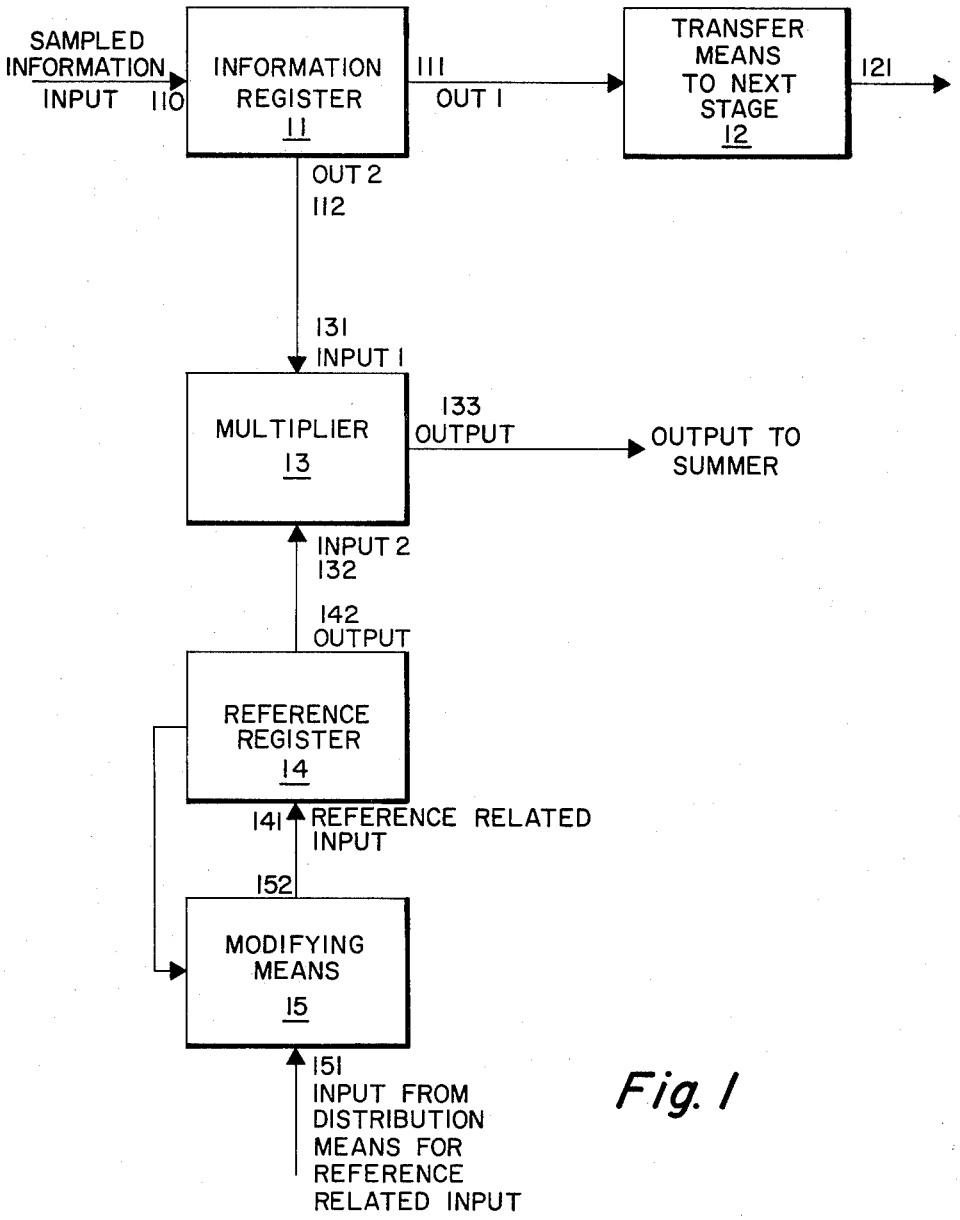
FIG. 1 is a simplified block diagram of one stage of a programmable correlator made in accordance with the present invention.

Referring to FIG. 1, there is shown one stage of a programmable correlator built in accordance with the present invention. Each stage utilizes an information register 11 and a reference register 14. The sampled information signal is placed as an input 110 to the information register 11. The output 111 from the information register reflects the contents of the information register and through transfer means 12 this signal 111 is transferred to the next stage.

The output 112 from the information register 11 is one of the inputs to the multiplier 13. The other input to the multiplier 13 is an output from the reference register 14. The reference register stores a signal related to the reference signal input. The actual signal on the reference register comes from a modifying means 15. The input 151 to the modifying means is fed from a distribution means 26 shown in FIG. 2. The stage shown in FIG. 1 has two principal outputs. The first output is 133, the multiplier output. The second output is on line 121, which goes to the input of the information register in the next stage.

Figure 2:
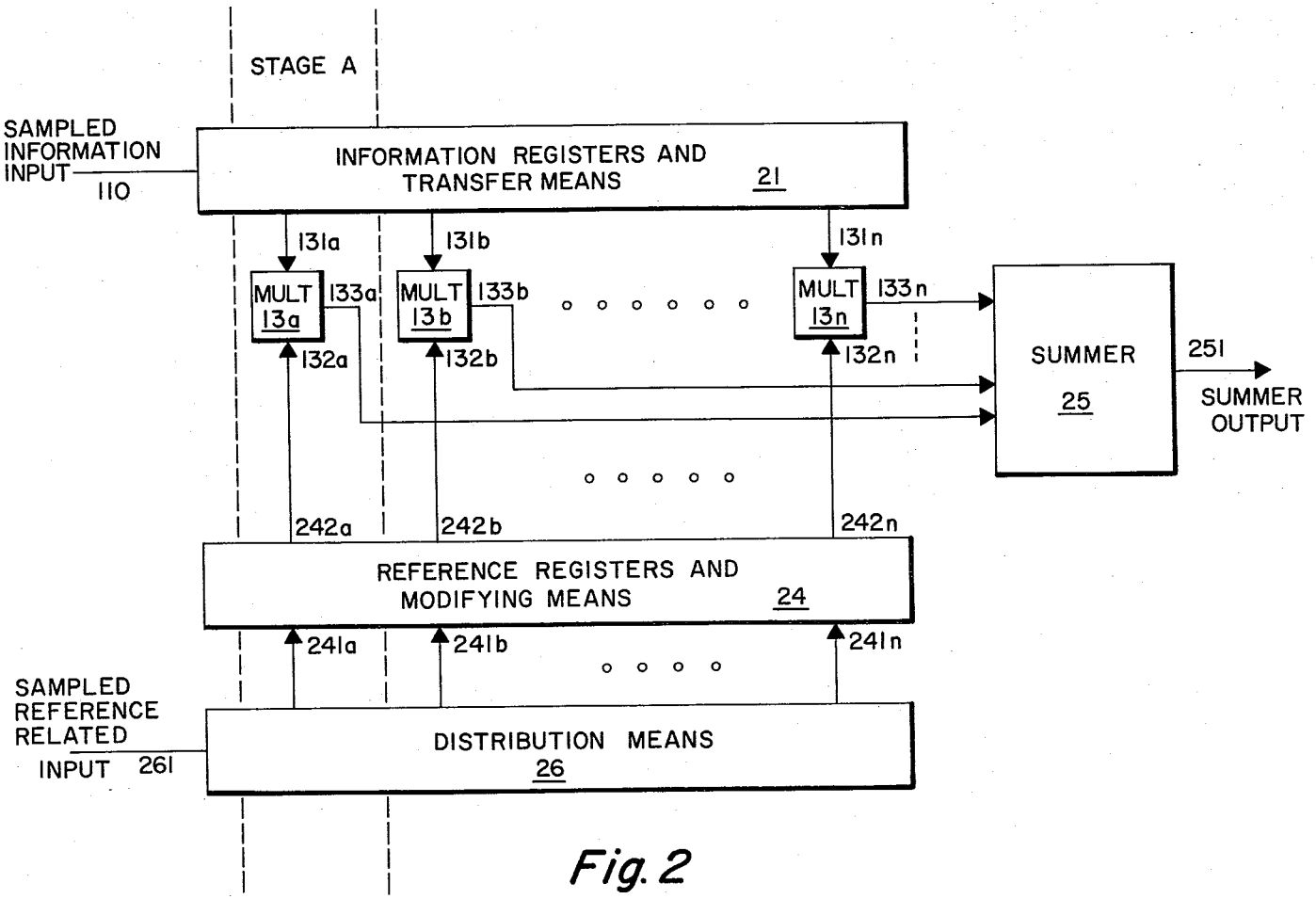
FIG. 2 is a simplified block diagram of an entire programmable correlator made in accordance with the present invention.

Turning now to FIG. 2, there is shown a complete, albeit simplified, block diagram of a programmable correlator in accordance with the present invention. The stage shown in FIG. 1 could be considered one stage, for example, stage A shown in FIG. 2. The sampled reference-related input 261 is fed into the distribution means 26. The distribution means distributes a sample to each stage of the correlator in such a way that each reference register among the reference registers and modifying means 24 contains one sample of the input 261. The output of each reference register among the reference registers and modifying means 24 is fed into its own multiplier by outputs 242*a* through 242*n*. The other inputs 131*a* through 131*n* to the multipliers come from the information registers and transfer means 21. The output of each multiplier 13*a* through 13*n* is then fed into the summer 25. The output 251 from the summer 25 is the output of the device.

Figure 3:
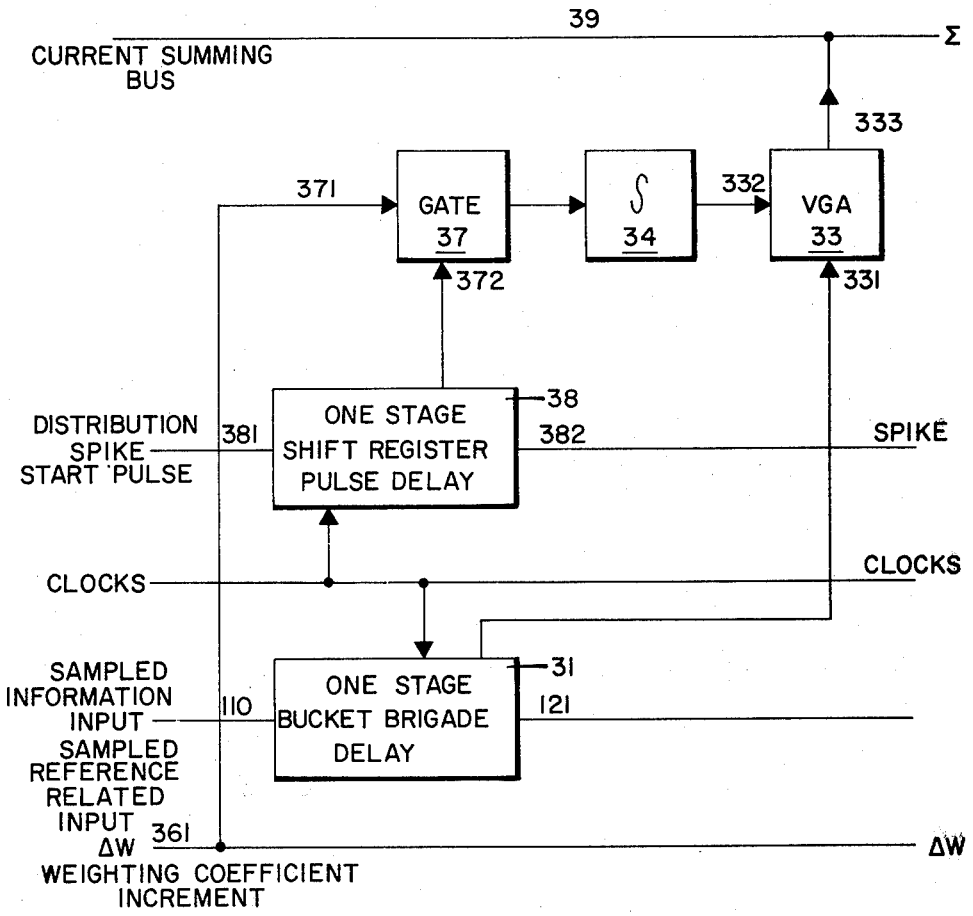
FIG. 3 is a simplified block diagram of a preferred embodiment of one stage of a programmable correlator in accordance with the present invention, wherein the modifying means FIG. 15 shown in FIG. 1 involves an integrator.

Referring now to FIG. 3, there is shown a particular embodiment in block diagram form of the stage shown in FIG. 1. The information register 11 of FIG. 1 is here shown as a one-stage bucket brigade delay 31. Its output 121 corresponds to the output 121 from the transfer means 12 of FIG. 1. The reference register 14 in combination with the modifying means 15 is realized in FIG. 3 by the integrator 34. The multiplier 13 is realized in FIG. 3 by the variable gain amplifier 33. The one stage shift register pulse delay 38 and the gate 37 shown in FIG. 3 are one stage of the distribution means 26 shown at FIG. 2. Applied as an input 371 to each gate in each stage is an incremental input ΔW. When an appropriate spike appears at the input 372 to gate 37, the gate passes the signal 361 into the integrator 34. The spike at input 372 is permitted to enter the gate 37 when it appears out of the one stage shift register pulse delay 38. Since each stage has its own pulse delay, a single starting spike at input 381 will travel down the line of shift register pulse delays, successively activating the gates of each stage. As a result, the reference signal itself can be understood as the signal appearing in the integrator 34, being the result of the summation of increments ΔW passed by gates 37. The summer 25 of FIG. 2 is shown in FIG. 3 in part as the current summing bus 39. As shown in FIG. 3, clock pulses are supplied as required to implement operation of the shift register pulse delays 38 and bucket brigade delays 31.

Figure 4:
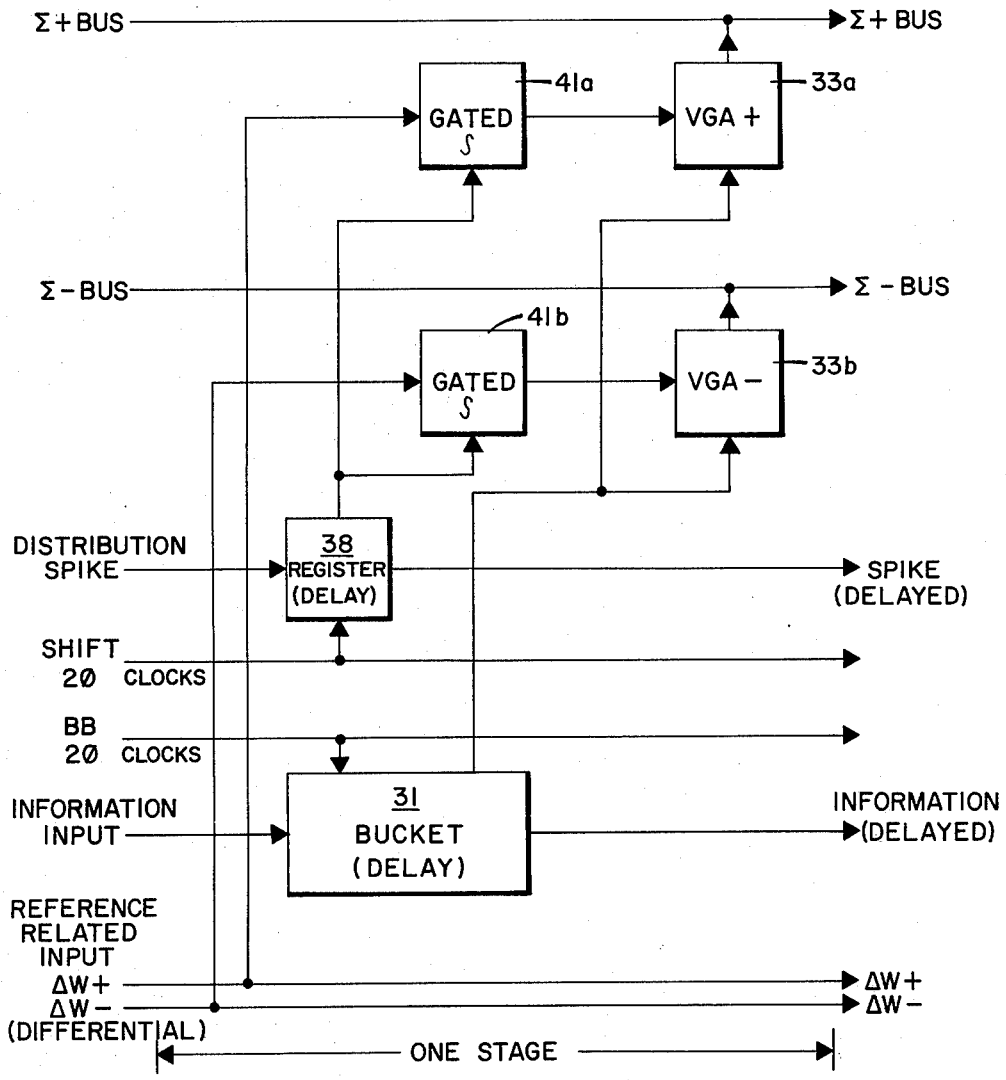
FIG. 4 is a more detailed block diagram of the embodiment illustrated in FIG. 3.

Turning now to FIG. 4, there is shown a more detailed embodiment of the invention than that of FIG. 3. Here differential signals are used for the reference-related inputs, the gated integrators, and the variable gain amplifiers. The gated integrators 41 correspond to the gates 37 and integrators 34 shown in FIG. 3. All other details of the circuit are the same as shown in FIG. 3, except that separate clock buses are shown to operate the register 38 and one stage bucket brigade delay 31. The embodiment shown in FIG. 4 permits the multiplication of signals in all four quadrants.

Figure 5:
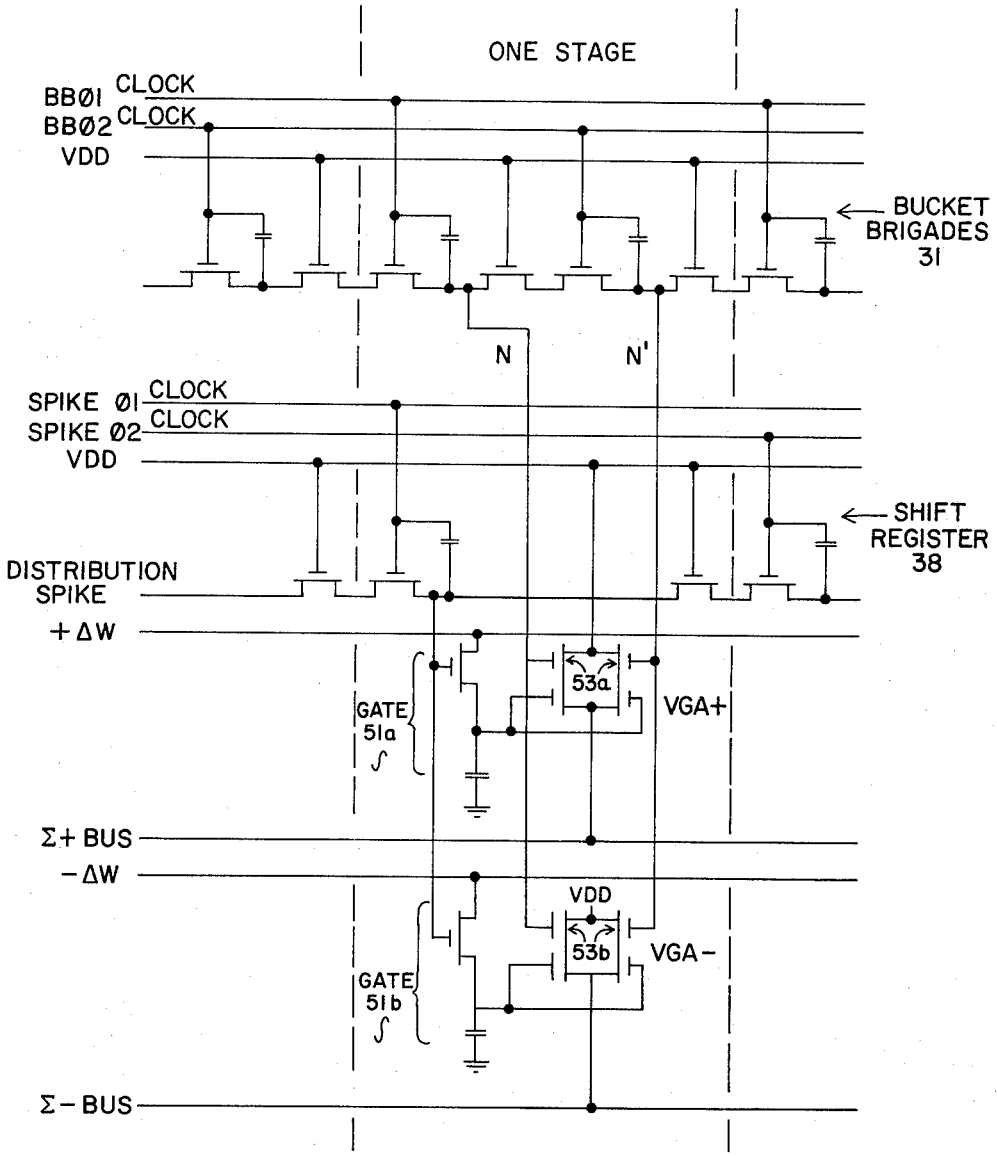
FIG. 5 is a simplified schematic for achieving the embodiment shown in FIG. 4.

Referring now to FIG. 5, there is shown a simplified schematic for implementation of the block diagram shown in FIG. 4. The variable gain amplifier pairs 33*a* and 33*b* shown in FIG. 4 correspond to the dual-gate MOS FETs 53*a* and 53*b* respectively shown in FIG. 5. The gated integrators 41*a* and 41*b* shown in FIG. 4 correspond to the MOS FET-capacitor combinations 51*a* and 51*b* in FIG. 5. It will be apparent that the MOS FET-capacitor combination is not necessarily a good integrator. Depending upon the on-resistance of the FET and the value of the capacitance, the combination could be made to behave as a sample-and-hold circuit or a low-pass filter. (In fact such behavior is desirable in some embodiments of the invention for use with certain types of reference signals. In particular, use of a sample-and-hold circuit or a low pass filter would amount to only a slightly different embodiment of the combination of the reference register 14 and modifying means 15 shown in FIG. 1.) A more nearly ideal integrator would require a more complicated circuit. Nevertheless in many applications the embodiments shown in FIG. 5 will be satisfactory.

Similarly, the dual-gate MOS FETs 53*a* and 53*b* shown in FIG. 5 are only approximations to ideal voltage gain amplifiers, since they approach linearity only over a relatively small dynamic range. Although the dual-gate FETs will be adequate for many applications, a multiplier having better linearity characteristics is disclosed, for example, in Bosshart, *A Monolithic Analog Correllator Using Charge-Coupled Devices,* pages 40–51 (Master's thesis, Massachusetts Institute of Technology, 1976).

The bucket delay 31 of FIG. 4 is implemented by the bucket brigade MOS FETs connected with capacitors to form bucket brigades 31 in accordance with techniques well known in the prior art. Similarly, the register 38 in FIG. 4 is implemented by the MOS FET-capacitor bucket brigade shift register 38 in FIG. 5, also in accordance with the same well known techniques.

The summation buses shown in FIG. 5 are intended to operate in a current mode summation circuit; such a circuit can be implemented by utilization of an operational amplifier equivalent to hold voltage on the bus constant; in accordance with embodiments well known in the prior art the currents would be summed through a feedback resistor in the operational amplifier circuit.

It will be apparent that, during the time that the sampled information signal is cascaded from one information register to the next, the present invention permits the storage in the device of the complete series of samples of a signal related to the reference signal. The presence in the device of embodiments of the modifying means 15 and reference register 14 shown in FIG. 1 permits the device to utilize a wide variety of algorithms to derive a reference signal. The shape of the reference signal, in turn, determines the nature of the filter achieved by the present invention. Various embodiments of the invention are suitable for fabrication as single integrated circuits.

Accordingly, while the invention has been described with particular reference to specific embodiments thereof in the interest of complete definiteness, it will be understood that it may be embodied in a variety of forms diverse from those shown and described without departing from the spirit and scope of the invention as defined by the following claims.

I claim:

1. A programmable correlator for correlating a sampled information signal with a programmable reference signal, such correlator comprising a plurality of correlator stages connected in cascade, each stage including:

(a) an information register, having an input for receiving at a given instant in time a sample of the information signal, a first output related to the signal stored in the register, and a second output also related to the signal stored in the register;

(b) a reference register, having an input for receiving a signal related to the programmable reference signal, and an output related to the stored signal;

(c) a multiplier, having a first input connected to the first output of the information register, a second input connected to the output of the reference register, and an output related to the product of the signals present at the multiplier's first input and its second input;

(d) first means, for transferring the sample of the information signal, from the second output of the information register in such stage, to the input of the information register in the next successive stage, such transfer being accomplished without undesirable amounts of changes in the signal stored in the reference register;

(e) second means, for summing the outputs of the multipliers in each stage; and (f) third means, distinct from the reference register, for distributing one of a series of consecutive samples of a signal related to the reference signal to each reference register of the device, so that collectively the reference registers have received all samples in the series.

2. The device of claim 1, further comprising, with respect to each stage, fourth means, for modifying the contents of such stage's reference register, in relation to each sample distributed to such reference register by the third means.

3. The device of claim 2, wherein the fourth means comprises means for adding to the contents of such stage's reference register the sample distributed to such reference register by the third means.

4. The device of claim 3, wherein the reference register and the fourth means together include a capacitance, the charge on which is related to the signal stored in the reference register.

5. The device of claim 2, wherein the fourth means comprises means for replacing the contents of such stage's reference register with the sample distributed to such reference register by the fourth means.

6. The device of claim 5, wherein the reference register and the fourth means together include a capacitance, the charge on which is related to the signal stored in the reference register.

* * * * *